US005700328A

United States Patent [19]

Kawanobe

[11] Patent Number: 5,700,328

[45] Date of Patent: Dec. 23, 1997

[54] METHOD OF WASHING A BLIND

[75] Inventor: Norio Kawanobe, Mito, Japan

[73] Assignee: Daitoh System Company, Ltd., Hitachinaka, Japan

[21] Appl. No.: 630,778

[22] Filed: Apr. 10, 1996

[30] Foreign Application Priority Data

May 13, 1995 [JP] Japan ..... HEI7-138731

[51] Int. Cl.[6] ..... B08B 3/12

[52] U.S. Cl. ..... 134/1; 134/6; 134/25.1; 134/25.4; 134/34

[58] Field of Search ..... 134/1, 69, 25.1, 134/25.4, 34

[56] References Cited

U.S. PATENT DOCUMENTS 4,897,122 1/1990 Schreiber et al. ..... 134/29
5,062,438 11/1991 Micheletti ..... 134/9

FOREIGN PATENT DOCUMENTS 64-5512 1/1989 Japan .
4-208127 7/1992 Japan .
5-38316 2/1993 Japan .

*Primary Examiner*—Peter A. Hruskoci
*Attorney, Agent, or Firm*—Wenderoth, Lind & Ponack

[57] ABSTRACT

A method of washing a blind which assures that a gap between adjacent louvers of the blind can easily be reduced to a shortest distance and dirty material can reliably be removed from the louvers. The method is practiced such that while the distance between the adjacent louvers is widened, a coil spring-like spacer is pressed against the blind. Offset ring-like portions of the spacer are inserted between the vertically adjacent louvers, and thereafter, the distance between the louvers is reduced to the diameter of a wire material forming the spacer while holding the offset ring-like portions in a clamped state. Subsequently, while the foregoing state is maintained, the blind is washed in a washing liquid circulated by a recirculating pump. Supersonic vibrations, generated by a supersonic vibration generator, are applied to the washing liquid. Then the blind is rinsed in a rinsing bath, and finally, after the coil spring-like spacer is disconnected from the blind, the blind is dried.

6 Claims, 13 Drawing Sheets

METHOD OF WASHING A BLIND

FIELD OF THE INVENTION

The present invention relates to a method of washing a blind widely used by attaching it to the window of an ordinary house, an office, a factory of the like for the purpose of preventing entrance of exterior light.

BACKGROUND OF THE INVENTION

Various types of dust or similar dirty material of which kind varies depending on the environment is likely to be adhesively deposited on louvers constituting the blind, and it is not easy to remove the dust from the louvers. With a small number of blinds, it is not impossible to wash each louver with an operator's hands using a map. At any rate, it is not easy to wash the louvers of the blind.

In view of the foregoing fact, there has been proposed the following blind washing method (refer to Japanese Patent Laid-Open NO. 64-5512).

Specifically, a method of washing a blind with plate-like light shading louvers arranged in parallel to each other with adjustable distance held between adjacent louvers, wherein while the adjacent louvers are sufficiently parted away from each other, a rod-like insert projecting from the surface of a flexible belt base material is inserted between the adjacent louvers, thereafter, the blinds are folded and the distance between the adjacent louvers is reduced while the rod-like insert is inserted into the folded blind, and the folded blind is washed in a washing liquid.

An advantage of the prior art is that since the distance between the adjacent louvers is reduced to a necessary minimum extent, the height as measured in the vertical direction is reduced and then the blind is washed, a washing operation can be achieved with a comparatively small washing apparatus.

However, since means usable for reducing the distance between the vertically adjacent louvers to a necessary minimum extent is a rod-like insert projecting from the surface of a flexible belt-like base material, the foregoing means has the following problems.

That is, according to the prior method, while the blind is expanded in the vertical direction, the belt-like base material comes in contact with the blind, and the rod-like insert is inserted into the adjacent louvers. However, for the reason that the distance between the adjacent louvers of one blind can not always be adjusted to be constant at all times, there arises a problem in that all rod-like inserts are not always inserted between the vertically adjacent louvers when the belt-like base material comes in contact with the blind. Another problem is that in almost every case, when an operator checks the blind after completion of the aforementioned operation, he often finds that many rod-like inserts are incorrectly inserted between the adjacent louvers, and there arises a necessity of manually inserting the rod-like inserts between the incorrectly inserted adjacent louvers by hand. Thus, another problem is that when the conventional method is employed, each inserting operation is inefficiently performed and rod-like inserts are inconveniently used.

SUMMARY OF THE INVENTION

The present invention has been made in consideration of the aforementioned background.

An object of the present invention is to provide a method of washing a blind which assures that a distance between adjacent louvers of the blind can easily be reduced to a necessary minimum dimension and dirty material can easily and reliably be removed from the louvers with small washing means without an occurrence of the problem that at the time of washing, all rod-like inserts projecting from the belt-like base material usable for reducing the distance between the adjacent louvers of the blind can not always be inserted between the adjacent louvers merely by allowing the belt-like base material to come in contact with the blind, and thus, many rod-like inserts are unavoidably inserted between the adjacent louvers by hand.

According to the present invention, there is provided a method of washing a blind comprising the following steps to be successively executed of;

a spacer inserting step of inserting offset ring-like portions between the vertically adjacent louvers by squeezing a coil spring-like spacer member against the louvers of a blind to be washed at a right angle relative to the louvers of which distance is enlarged and which are held in the horizontal direction, the offset ring-like portion being located corresponding to each part of the coil spring-like spacer member (i.e., by a quantity of one pitch), a louver distance reducing step of reducing the distance between the vertically adjacent louvers of the blind by holding the offset ring-like portions in the clamped state so as to allow the gap corresponding to the diameter of a wire forming the offset ring-like portions to be left as it is, a washing step of washing the blind while the distance between the adjacent louvers is reduced, and a drying step of drying the blind while the coil spring-like spacer member is disconnected from the washed blind.

The coil spring-like spacer member should not be limited to only an annular contour as seen in a plan view, and it may exhibit the contour of, e.g., a triangle, a rectangle, a pentagon or the like. Although the coil spring-like spacer member exhibit a polygon, it is preferable that each corner of the polygon is rounded. In addition, the coil spring-like spacer member may be such that a part of the substantially annular coil as seen in a plan view is inwardly bent and the bent part is formed to a substantially U-shaped recessed contour to surround the center of the annular coil. In this case, as described later, when the coil spring-like spacer member is set for washing the blind, the strings disposed for connecting the louvers of the blind to each other or changing an inclination angle of the blind are protected them from damage caused by a washing operation while they are inserted in the substantially U-shaped contour.

It is acceptable that the diameter of a wire forming the coil spring-like spacer member is set to 2 mm or more. In other words, it is acceptable that the diameter of the wire forming the coil spring-like spacer member is determined such that the constant distance between the adjacent louvers determined when a part of the offset ring-like portion equal to one pitch of the coil spring-like spacer member is inserted between the louvers becomes a minimum smallest limit distance for effectively performing a washing operation when washing the blind while it is dipped in a washing liquid or washing the blind while brushes are inserted into the gap between the adjacent louvers. To this end, the diameter of the wire is set to 2 mm or more.

A material for the coil spring-like spacer member can be selected from various kinds of materials, and in the case that the washing step is executed while the blind is dipped in the washing liquid and at this time supersonic vibration is utilized, it is convenient that the coil spring-like spacer member is molded of a plastic material or a similar non-metallic material. This is because in the case where the coil spring-like spacer member is molded of a plastic material or other non-metallic material, the surface or the coating layer of a part of the louver coming in contact with the coil spring-like spacer member is not injured when a washing operation is performed utilizing supersonic vibration.

In case of other washing means, e.g., in the case that a washing operation is performed with brushes inserted into the gaps between the louvers of the blind, it is not necessary that the material employable for the coil spring-like spacer is limited to a specific material.

It is suitable that the diameter of the offset ring-like portion associated with the coil spring-like spacer member is dimensioned to a size corresponding to the width of the louver, i.e., within the range from slightly short of the width of the louver to slightly long of the same.

To execute the washing step, washing means suitable for washing the blind while the distance between the adjacent louvers is assumed as a minimum limit can freely be employed. For example, as mentioned above, the means for performing a washing operation while the blind is dipped in the washing liquid can be employed, and moreover, the means for performing a washing operation while brushes are inserted into the gaps between the adjacent louvers can be employed.

For example, in the case that a washing operation is performed while the blind is dipped in the washing liquid, it is suitable that the washing liquid is displaced during the washing operation, and the displacement of the washing liquid can be achieved, e.g., by stirring the washing liquid with the aid of stirring means or by blowing air in the washing liquid. In this case, to increase a washing effect, it is suitable that supersonic vibration is transmitted to the blind via the washing liquid, and it is suitable that a frequency of the supersonic vibration is set to, e.g., 47 kHz. It is obvious that the frequency of the supersonic vibration should not be limited to the above-noted one, and other suitable frequencies belonging to the range of the supersonic vibration can be selected. It is sufficient that such high frequency vibration is applied to the washing liquid for a short time of one to two minutes.

Since the present invention is constructed in the above-described manner, a washing operation can be performed for the blind in the following manner.

First, the spacer inserting step is executed.

For example, the blind is expanded while it is engaged with a window, and the distance between the adjacent louvers is expanded to a maximum extent. A part of the offset ring-like portions corresponding to the coil spring-like spacer member is inserted between the vertically adjacent louvers by squeezing, e.g., two coil spring-like spacer members against the blinds of which distance is enlarged in the above-described manner.

In the case that a part of a substantially annular coil as seen in a plan view is inwardly bent and the bent part exhibits a substantially U-shaped recessed contour while surrounding the center of the annular coil therein, when the coil spring-like spacer member is set to the blinds, the strings disposed to connect the respective louvers to each other or changing the inclination angle of the louvers are positioned at certain positions and they are set such that they are involved in the substantially U-shaped recessed part.

In the case that the coil spring-like spacer member is suspended while its upper end is supported, the coil spring-like spacer member has a length such that the upper end of the coil spring-like spacer member substantially corresponds to the upper end of the blind to be washed and its lower end substantially corresponds to the lower end of the blind. The number of offset ring-like portions is larger than the number of the gap of the louvers, and each of the offset ring-like portions corresponds to the position of ¼ as measured from the both the sides of lateral width of the blind. In the case that the coil spring-like spacer member includes a bent portion which is constructed such that the center of the coil spring-like spacer member is involved in the substantially U-shaped recessed contour at a part of the substantially annular coil as seen in a plan view, the coil spring-like spacer member corresponds to a certain position of the strings disposed for connecting the respective louvers of the blind to each other or changing the inclination angle of the blind.

Then, when the coil spring-like spacer member is squeezed against the blind side from, e.g., the upper end side, the corresponding part of the offset ring-like portions of the coil spring-like spacer member is squeezed or positioned between the vertically adjacent louvers of the blind so that it is inserted therebetween.

This is described in more detail. When the coil spring-like spacer member coming in contact with the front surface of the blind is slightly squeezed toward the blind side by sliding an operator's hand along the coil spring-like spacer while the upper end of the blind is supported and suspended, the corresponding offset ring-like portions can easily be inserted between the vertically adjacent louvers in a single operation. Even though the vertically adjacent louvers and the corresponding offset ring-like member are located at the vertically non-coincident position, since the coil spring-like spacer member is spirally extended, they are displaced to the vertically coincident position as an operator's hand slides along the coil spring-like spacer member in that way, whereby the offset ring-like portions are inserted between the corresponding louvers.

This operation can very simply and speedily be achieved without any necessity of adjusting the distance between the adjacent louvers.

Thereafter, the louver distance reducing step is executed.

The blind expanded to a maximum extent is raised up so that the distance of the vertically adjacent louvers is reduced to a dimension corresponding to the diameter of the wire of the coil spring-like spacer member.

When the blind is raised up to reduce the distance between the louvers, since the offset ring-like portions of the coil spring-like spacer member are inserted between the vertically adjacent louvers, the vertically adjacent louvers hold the offset ring-like portions in the clamped state, the reduction of the distance between the louvers is stopped, and the distance of the louvers is adjusted and held to an adequate smallest limit.

Next, the washing step is executed.

To execute the washing step, besides the means for performing a washing operation by dipping the blind in the washing liquid, various means such as means for performing a washing operation by inserting brushes between the adjacent louvers of the blind can be employed.

In the case that a washing operation is performed by dipping the blind in the washing liquid, the washing operation is performed in the following manner.

A washing liquid prepared, e.g., by dissolving a neutral detergent or an alkaline detergent in water is put in a washing bath. The washing liquid is heated to, e.g., 40° C. or more, the washing liquid is displaced by actuating suitable means, the blind including the louvers of which distance is adjusted to a minimum extent is suspended in the washing bath or the blind is placed on a frame-like table put in the washing liquid so that the blind is dipped in the washing liquid to wash the blind.

In addition, supersonic vibration generating means is placed in the washing bath, and supersonic vibration is transmitted to the blind via the washing liquid so that dirty material adhesively deposited on the louver can be floated up by cavities caused by the supersonic vibration. It is acceptable that the frequency of the supersonic vibration is set to 47 kHz and the supersonic vibration is applied to the blind for a time of 1 to 2 minutes. Since the dirty material floated up by the action of the cavities caused by supersonic vibration is parted away from the surface of the louver by the displacement of the washing liquid, an excellent washing effect is obtainable.

Thereafter, the blind is rinsed by, e.g., dipping it in flowing water or it is dipped in water having a special rinsing agent or a water separating agent for rinsing the blind.

In the case that a washing operation is performed by inserting brushes into the adjacent louvers, a washing operation can be performed in the following manner.

The blind is placed on a suitable holder such as an idling roller and an adequately diluted washing liquid adhere to the blind. A brush reciprocating in the longitudinal direction of the louver or a rotating brush is inserted into the gap of the louvers in one direction or in both directions so that the dirty material is removed from the louver by the physical function of the brush and the chemical function and the physical function caused by the washing liquid. This washing operation is performed from one end of the blind and to the other end of the same. After completion of the washing operation, the washing liquid is flown away by feeding water or feeding water added with a rinsing agent or a water separating agent, whereby the washing operation is completed.

Thereafter, a drying step is executed for the washed blind.

The drying step is practiced such that the upper end of the blind is engaged with engagement means located at a high position, the blind is expanded to enlarge the distance between the adjacent louvers, and the coil spring-like spacer member is disconnected from the blind. For example, the blind is forcibly dried by blowing hot air to the blind or it is naturally dried by leaving the blind in the room or outside of the room as it is. In some cases, it is sufficient that the blind is dried merely by leaving the blind as it is without any particular action executed.

Other objects, features and advantages of the present invention will become apparent from reading the following description which has been made in conjunction with the accompanying drawings.

DESCRIPTION OF THE PREFERRED EMBODIMENTS

The present invention will be described in detail hereinafter with reference to the accompanying drawings.

FIG. 1 to FIG. 12 show a first embodiment of the present invention, respectively.

First, main components and devices, i.e., coil spring-like spacer 2, a washing bath 2 and a rinsing bath 3 will be described below.

Figure 11:
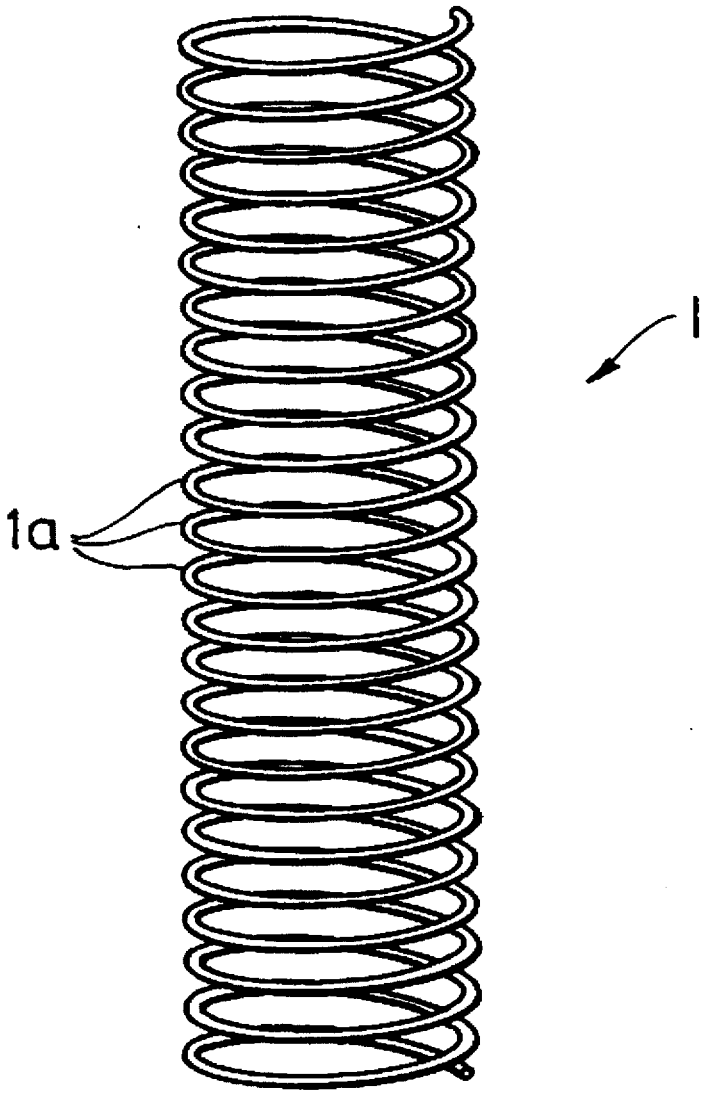
FIG. 11 is a schematic perspective view of the coil spring-like spacer.

As shown in FIG. 11, the coil spring-like spacer 1 is a coil-like member, and it is assumed that a coil spring-like spacer 1, dimensioned to a size of a blind B to be washed, is prepared. The coil spring-like spacer 1 exhibits an annular contour as seen in a plan view, and has a diameter of about 70 mm and a wire constituting the coil spring-like spacer 1 has a diameter of 2 mm. The coil spring-like spacer 1 is molded of an elastic plastic material.

Figure 8:
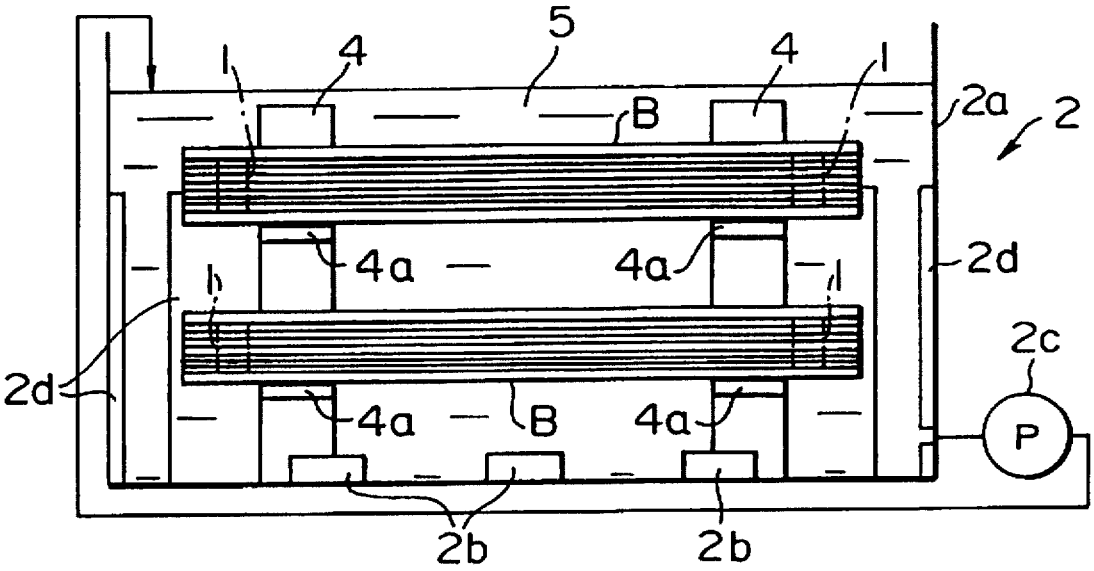
FIG. 8 is an illustrative side view which shows two blinds each having the offset ring-like portions of the coil-like spacer inserted between the adjacent louvers of the blinds while the blind is contracted and disposed in a washing bath.

As shown in FIG. 8, a washing bath 2 is constituted of a box-shaped bath main body 2*a*, a plurality of supersonic vibration generators 2*b* arranged on the bottom of the bath main body 2*a*, a recirculating pump 2*c* disposed such that a washing liquid is sucked from the lower part of the bath main body 2*a* and is discharged from the upper part of the bath main body on the opposite side, and panel heaters 2*d* attached to the inner surfaces of the side walls of the bath main body 2*a*.

The supersonic vibration generators 2b are adapted to generate a supersonic vibration of 47 kHz are employed for executing the first embodiment of the present invention.

The panel heaters 2d are intended to heat a washing liquid 5 filled in the bath main body 2a to an adequate temperature and each panel heater 2d includes a temperature sensor and a controller for controlling a quantity of electricity to be supplied to the panel heater 2d in response to an output signal from the temperature sensor. The temperature sensor and the controller are not shown in the drawings. The temperature of the bath main body 2a can freely be set, and according to the first embodiment of the present invention, it is acceptable that the temperature is set to 40° C.

As to the washing liquid 5, which is provided in the bath main body 2a, it is sufficient that an adequate kind of detergent selected corresponding to the nature of the dirty material deposited on the blind B to be washed is added to water. In the first embodiment of the present invention, the washing liquid 5 is intended to wash the blind B used in an ordinary office, and since the content of the dirty material generally comprises dust, tar of tobacco or the like, it is acceptable that an alkali based detergent is added to water to prepare a washing liquid.

Two pair of stands 4 are vertically displaceably arranged in the bath main body 2a, and holding arms 4a laterally extending from the intermediate position of each stand 4 serve to hold the blind B thereon for washing the blind B.

Figure 9:
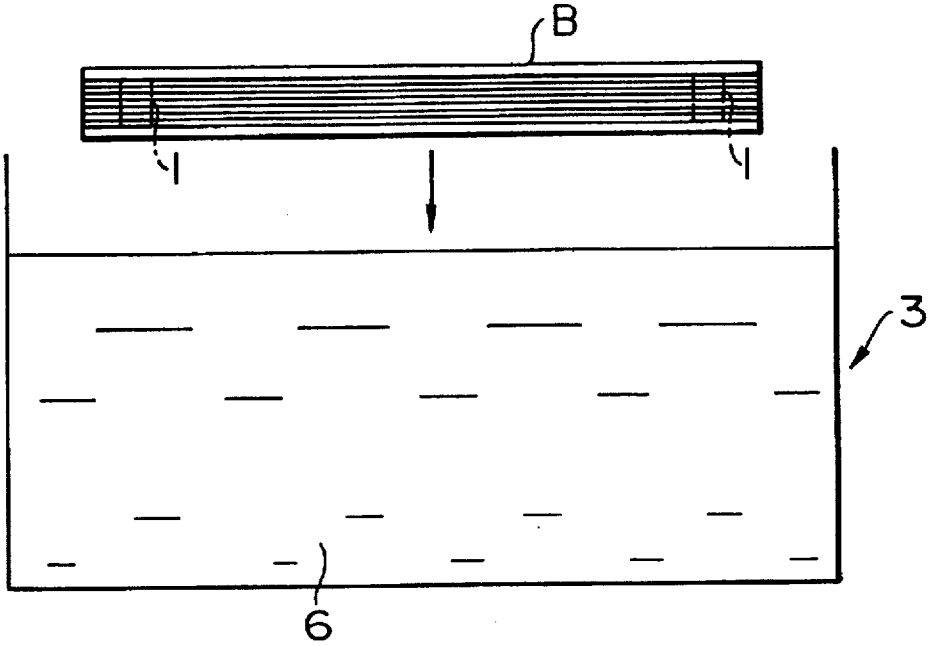
FIG. 9 is an illustrative front view which shows the washed blind prior to being placed in a rinsing bath.

As shown in FIG. 9, a rinsing bath 3 is a box-like bath for receiving a rinsing liquid 6 therein, and it is acceptable that dimensions and a capacity of the rinsing bath 3 are determined such that the blind B can be dipped in the rinsing bath 3. It is sufficient that the rinsing liquid 3 is merely water but rinsing liquid having a rinsing agent and a water separating liquid added to water may be employed for executing this operation.

Figure 12:
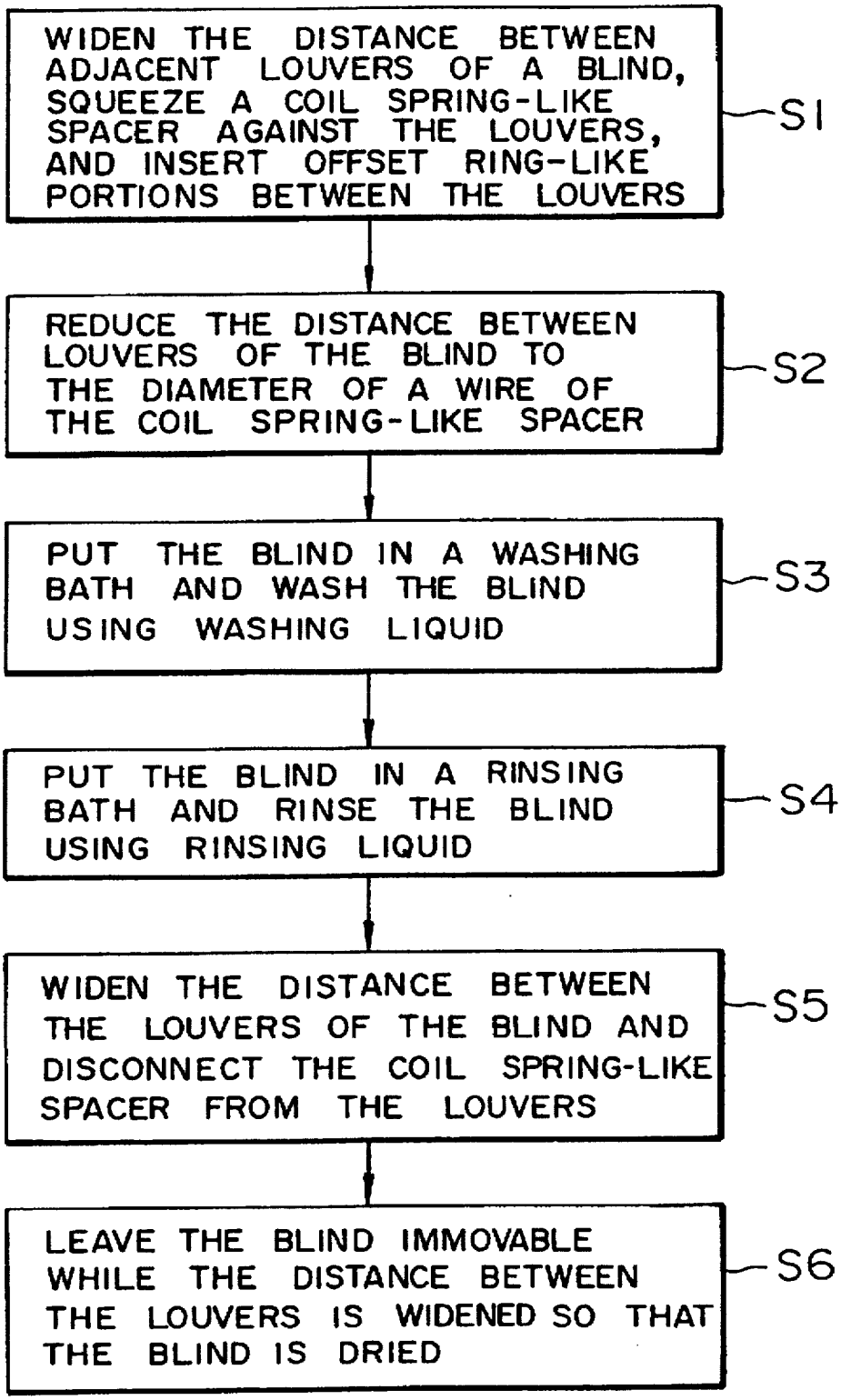
FIG. 12 is a flowchart which shows the steps to be executed in accordance with a first embodiment of the present invention.

According to the first embodiment of the present invention, the blind B is washed using the above-described components and devices in conformance with steps shown in FIG. 12.

As shown in a step S1, first, a step of inserting a spacer is executed.

Figure 1:
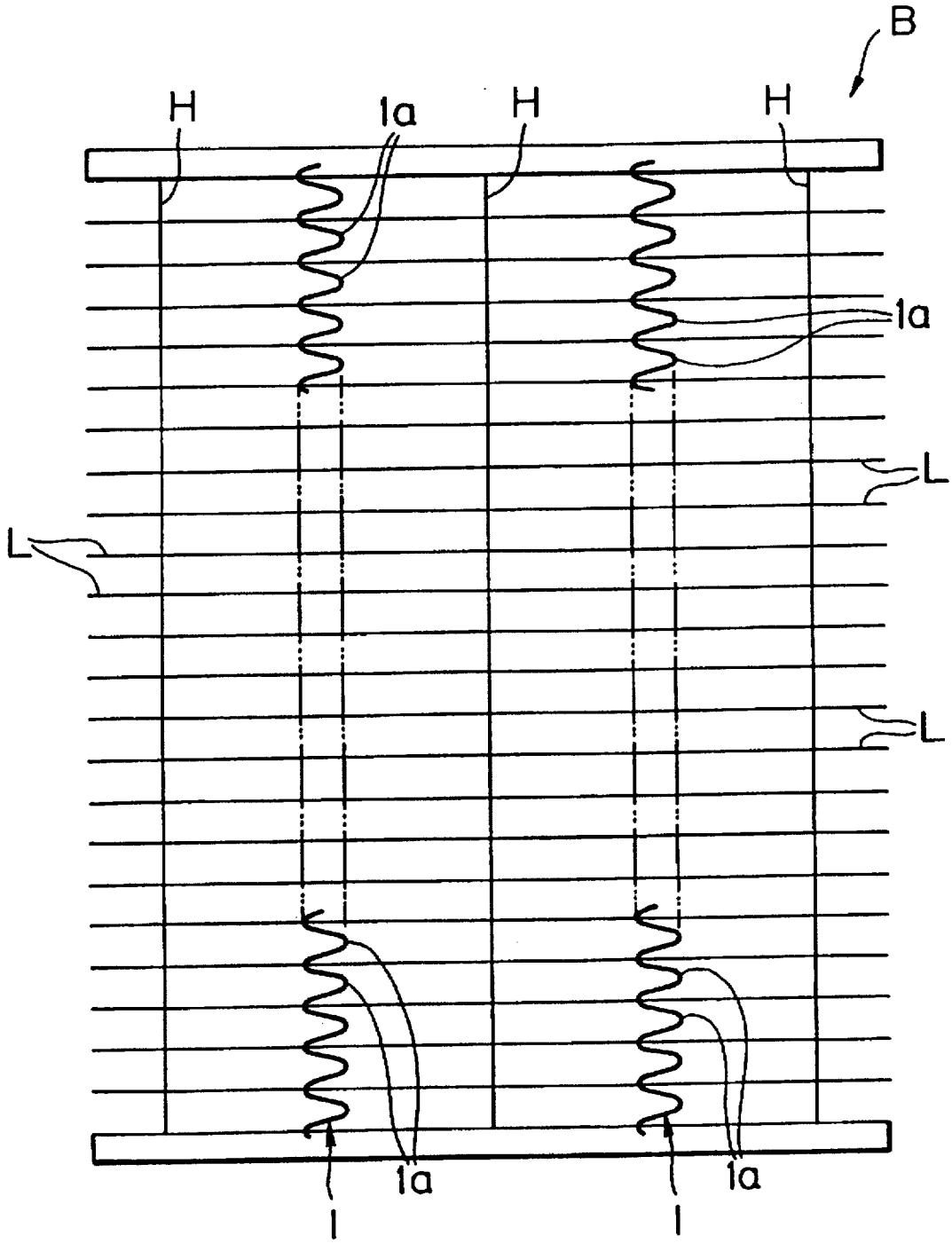
FIG. 1 is schematic front view which shows a coil-like spacer engaged with an expanded blind with louvers held in the horizontal state.

As shown in FIG. 1, the blind B is expanded to such a maximum extent that the window is covered with the blind B in conformance with a manner of usage thereof, the distance between adjacent louvers is enlarged to a maximum extent, while the louvers are held into a horizontal state, two coil spring-like spacers 1 are positioned against the blind B with a vertical attitude so that offset ring-like portions 1a of the coil spring-like spacer 1 are inserted between adjacent louvers L of the blind B located one above another.

The two coil spring-like spacers 1 are located at the positions away from the opposite ends of the blind B by a distance of one quarter of the width of the blind B.

Figure 2:
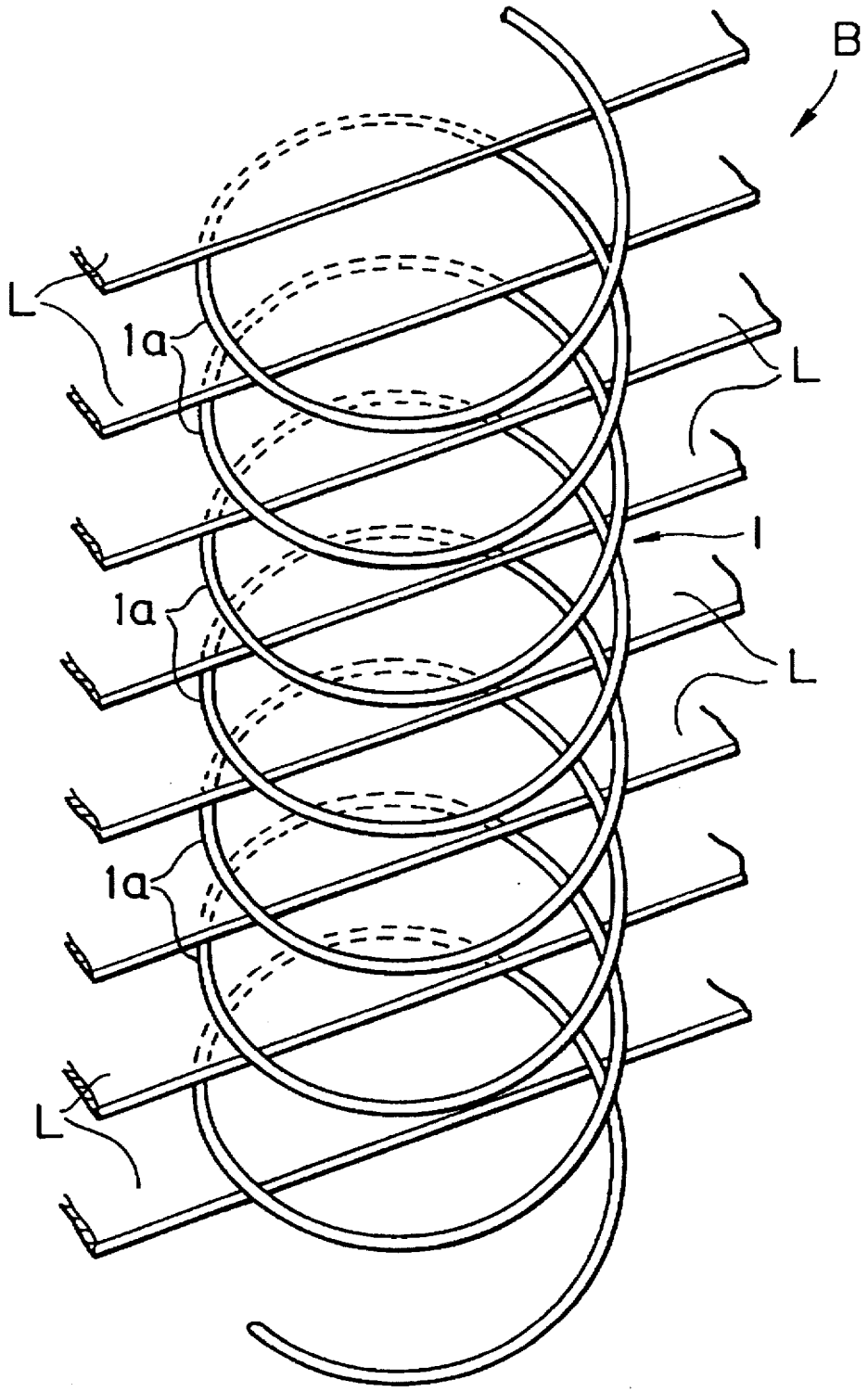
FIG. 2 is a illustrative perspective view of the blind which shows offset ring-like portions inserted between adjacent louvers of the blind.
Figure 3:
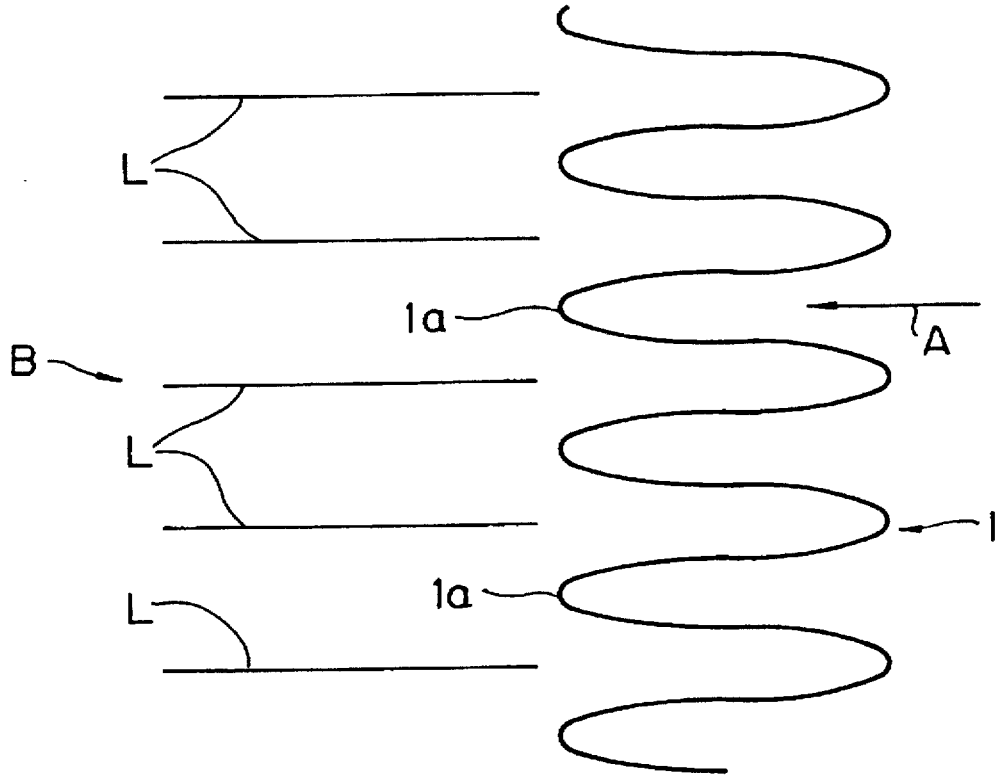
FIG. 3 is an illustrative side view of the blind which shows the state directly before the offset ring-like portions of the coil-like spacers are inserted between the adjacent louvers of the blind.
Figure 4:
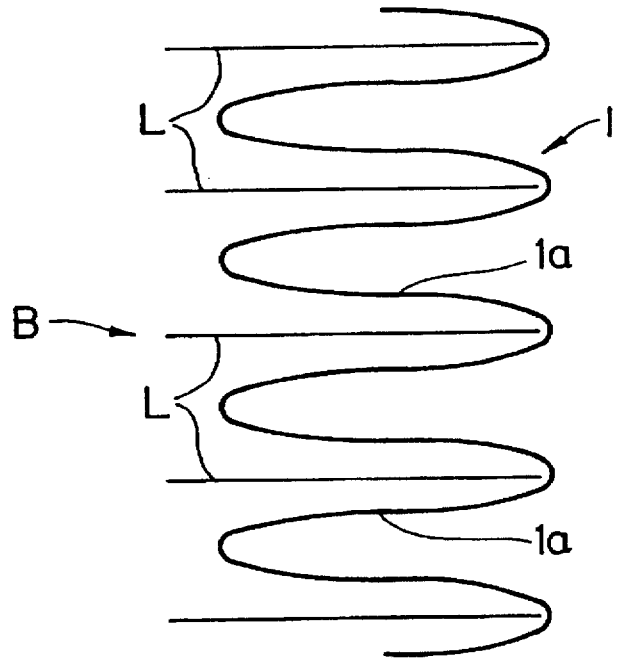
FIG. 4 is an illustrative side view of the blind which shows the state in which offset ring-like portions of the coil-like spacer are inserted between the adjacent louvers of the blind.

The above-described operation will be explained in more detail. As shown in FIG. 3, when the coil spring-like spacer 1 is brought in contact with the adjacent louvers L of which distance is enlarged and the coil spring like-spacer 1 is squeezed toward the louver L side in the A arrow-marked direction, respective offset ring-like portions 1a of the coil spring-like spacer 1 are inserted between the vertically adjacent louvers L as shown in FIG. 2 and FIG. 4.

The squeezing operation of the coil spring-like spacer 1 in the A arrow-marked direction can simply be performed by squeezing the coil spring-like spacer 1 in the A arrow-marked direction while sliding an operator's hand from the above to the below. Even though the respective offset ring-like portions 1a are slightly deviated from the distance between the blinds B, since the coil spring-like spacer 1 itself is constructed in the form of a spiral contour and has resiliency, the foregoing deviation disappears merely by thrusting the coil spring-like spacer 1 in the A arrow-marked direction while sliding an operator's hand along the coil spring-like spacer 1 from above to below, whereby the offset ring-like portions 1a are inserted between the louvers L.

Thereafter, a step of reducing the distance between the louvers as represented by a step S2 in FIG. 12 is executed.

Figure 5:
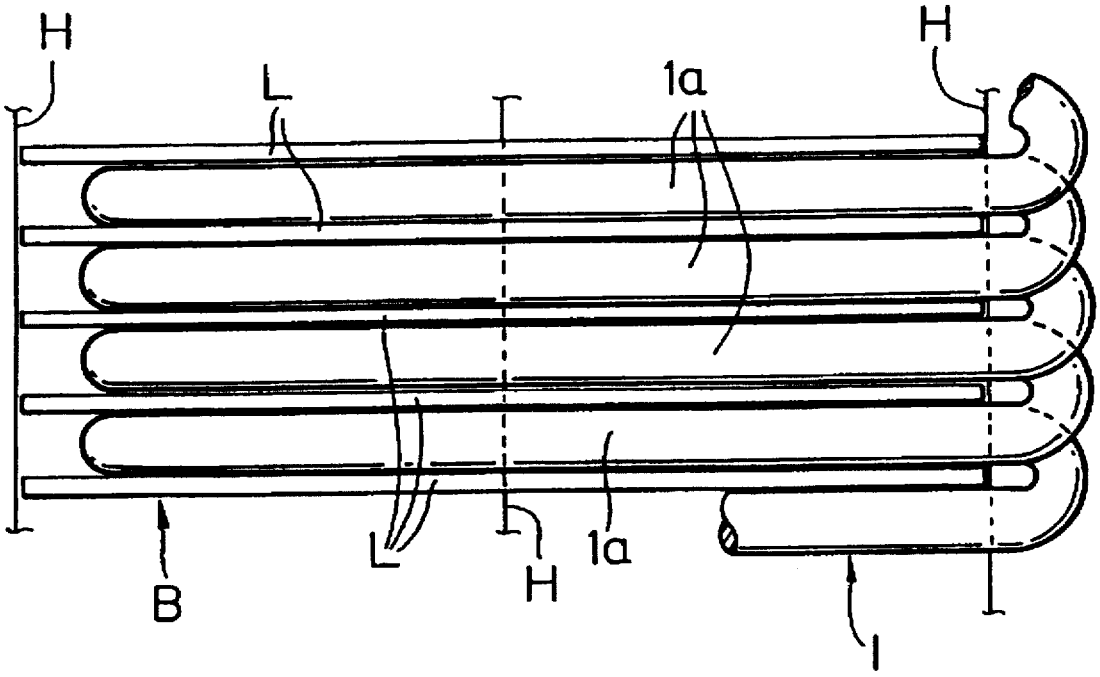
FIG. 5 is a fragmentary enlarged side view of the blind which shows the offset ring-like portions of the coil-like spacer inserted between the adjacent louvers while the blind is contracted.
Figure 6:
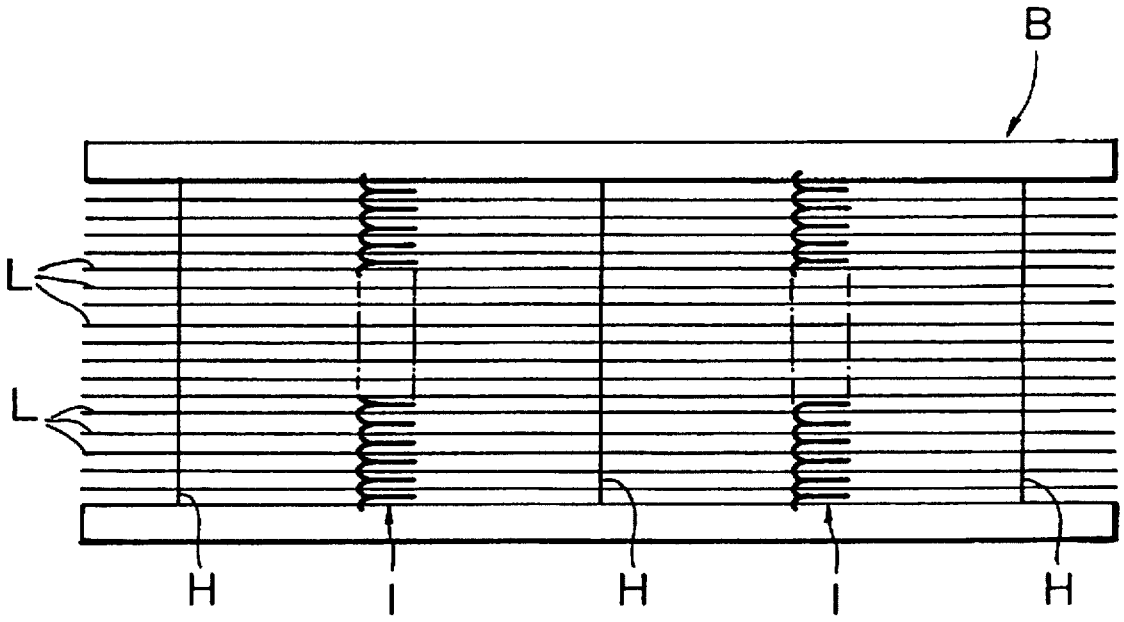
FIG. 6 is an illustrative front view of the blind which shows the offset ring-like portions of the coil-like spacer inserted between the adjacent louvers of the blind while the blind is contracted.
Figure 7:
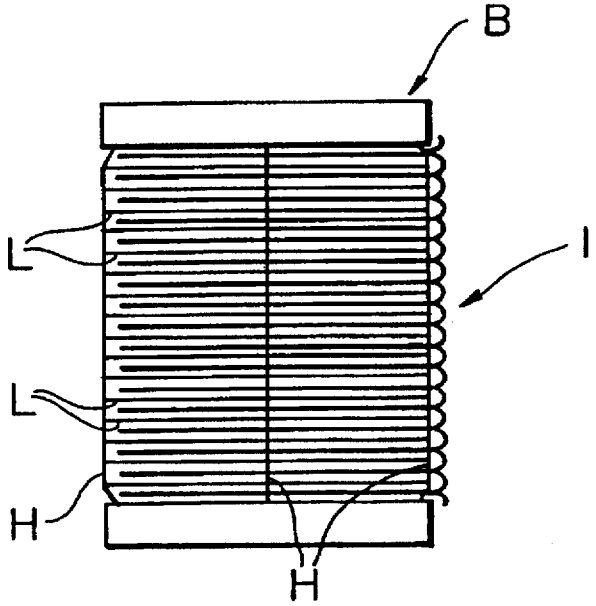
FIG. 7 is an illustrative side view of the blind which shows the offset ring-like portions of the coil-like spacer inserted between the adjacent louvers of the blind while the blind is contracted.

As mentioned above, the blinds B expanded to a maximum extent are raised up to reduce the distance between the louvers B in conformance with a manner of usage thereof. Since the offset ring-like portions 1a of the coil spring-like spacer 1 are inserted between the vertically adjacent louvers L as shown in FIG. 2, the distance between the louvers is reduced to a dimension of 2 mm corresponding to a diameter of the wire constituting the offset ring-like portion. FIG. 5 shows this state.

Next, a step of washing is executed.

First, as represented by the step S3 in FIG. 12, the blind B is put in the bath main body 2a of the washing bath 2 so that it is washed therein.

The washing liquid 5 is preliminarily put in the bath main body 2a of the washing bath 2, and the heaters 2d are activated to hold the washing liquid 5 at a temperature of 40° C. While the foregoing state is maintained, the blinds B are held on the arms 4a of the pair of stands 4 as shown in FIG. 8 and are dipped in the bath main body 2a of the washing bath 2 so as to allow the washing bath 2 to perform a washing operation.

In this case, the recirculating pump 2c is operated to recirculate the detergent solution in the bath main body 2a, and the supersonic generators 2b are activated to generate supersonic vibration.

The supersonic vibration generated by the supersonic vibration generators 2b is transmitted to the respective louvers of the blind B so that various dirty material adhesively deposited on the louvers L of the blind is floated up by the action of cavities generated by the supersonic vibration.

On the other hand, flow is caused with the washing liquid 5 in the bath main body 2a by the function of the recirculating pump 2c so that the dirty material floated from the surfaces of the respective louvers L is washed away from the surfaces of the louvers L, resulting in a washing effect being attained.

It is obvious that the aforementioned action is excellently achieved by opening the gap of about 2 mm between the vertically adjacent louvers L in the presence of coil spring-like spacers 1, and the foregoing gap is closed to the minimum limit which assures that the blind B is washed while it is compactly folded.

According to the first embodiment of the present invention, the supersonic generators 2b and the recirculating pump 2c are driven for two minutes whereby the respective louvers L of the blind B are sufficiently washed.

The position where the offset ring-like portions 1a of the coil spring-shape spacer 1 come in contact with the louvers L exhibits an excellent washing effect probably due to relative fine displacement caused by the supersonic vibration.

After completion of the washing treatment for two minutes, as represented by step S4 in FIG. 12, the blind B is placed in the rinsing bath 3 to rinse the blind B. As shown in FIG. 9, the rinsing treatment is achieved by dipping the blind B once in the rinsing liquid 6, slightly displacing it and then pulling it up.

Figure 10:
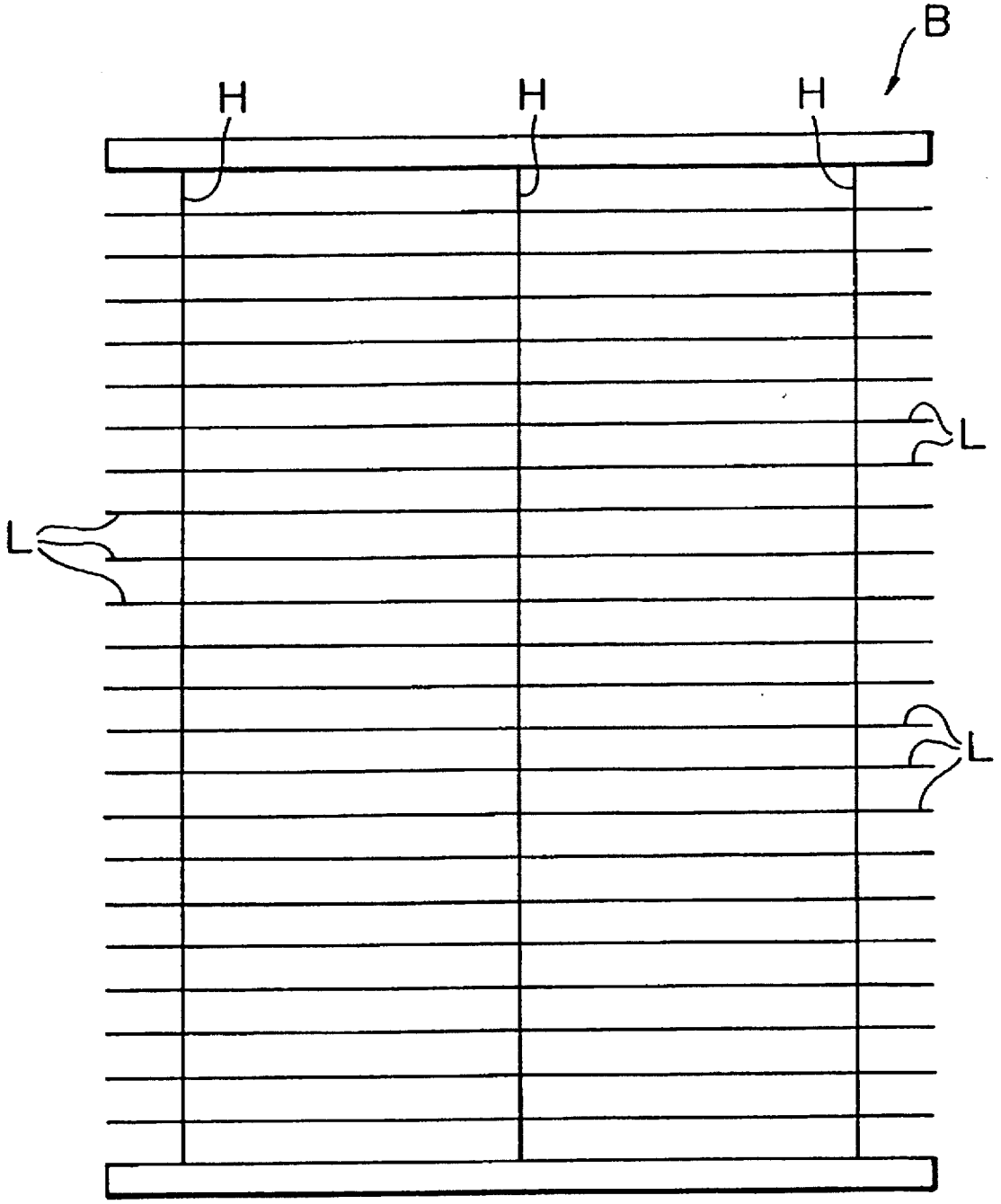
FIG. 10 is a schematic illustrative front view which shows the blind expanded with the coil spring-like spacer removed therefrom upon completion of a washing operation.

After completion of the rinsing step, a drying step is executed. First, as represented by step S5, the upper end of the rinsed blind B is engaged with engagement means located at an elevated position, and it is expanded as shown in FIG. 10 in conformance with a manner of usage thereof so that the coil spring-like spacer 1 is disconnected from the blind B.

Next, as represented by step S6 in FIG. 12, the blind B is expanded and then dried while it is left immovable. The state of extension of the blind B is shown as in FIG. 10. In the first embodiment of the present invention, since a rinsing liquid having a rinsing agent and a water separating agent added thereto is employed for the blind B, water is easily separated from the blind B so that the blind B can speedily be dried.

Next, a second embodiment of the present invention will be described. FIG. 13 to FIG. 17 show the second embodiment of the present invention, respectively.

First, main components and devices to be used for a method of washing a blind in accordance with the second embodiment of the present invention, i.e., a coil spring-like spacer 11, a reciprocable brush 12 and a rotary brush 13 will be described.

Figure 13:
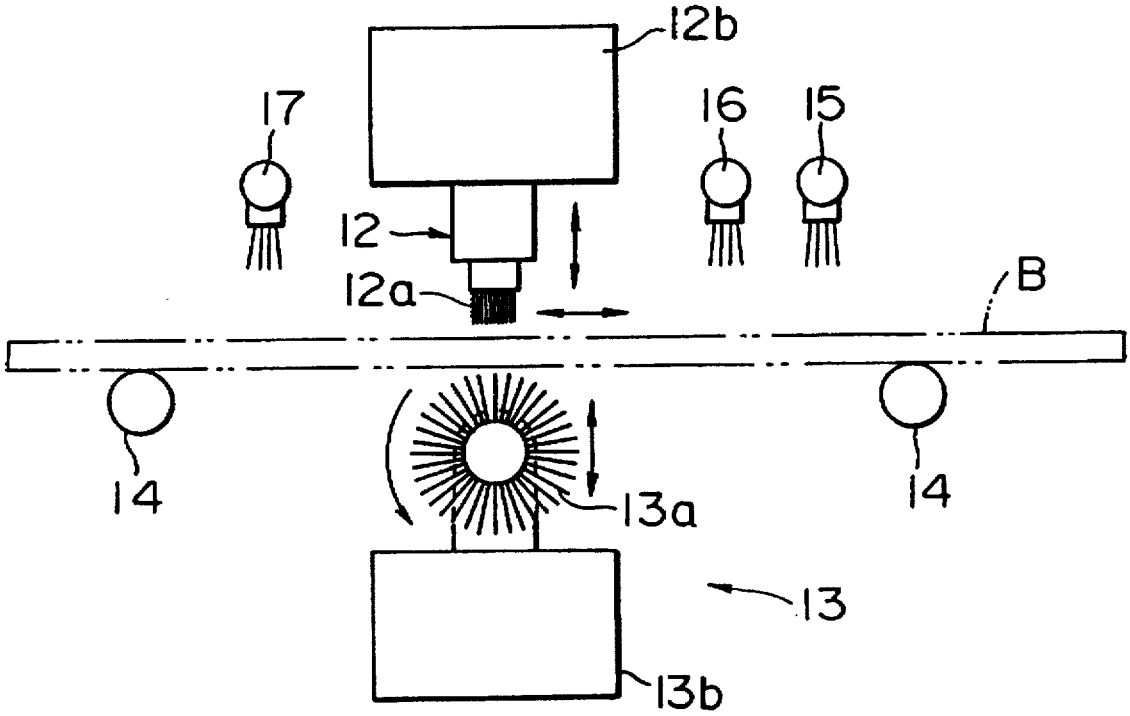
FIG. 13 is a schematic view which shows the state in which the blind is washed by reciprocable brushes and a rotary brush.

As shown in FIG. 13, the reciprocable brush 12 is arranged in the proximity of the intermediate position between fore and rear idling rollers 14 each serving as a blind receiving portion so that it can be raised and lowered, and moreover, displaced in the forward/rearward direction (in the leftward/rightward direction in FIG. 13) by a driving portion **12*b* belonging to the reciprocable brush 12**.

The rotary brush 13 is arranged below the reciprocable brush 12 so that it can be raised and lowered, and moreover, rotated by a driving portion **13*b* belonging to the rotary brush 13**.

A water ejecting nozzle 15 and a water liquid ejecting nozzle 16 are arranged in front of the reciprocable brush 12, i.e., on the right side of the same, and a water ejecting nozzle 17 is arranged rearward of the reciprocable brush 13, i.e., on the left side of the same.

Figure 16:
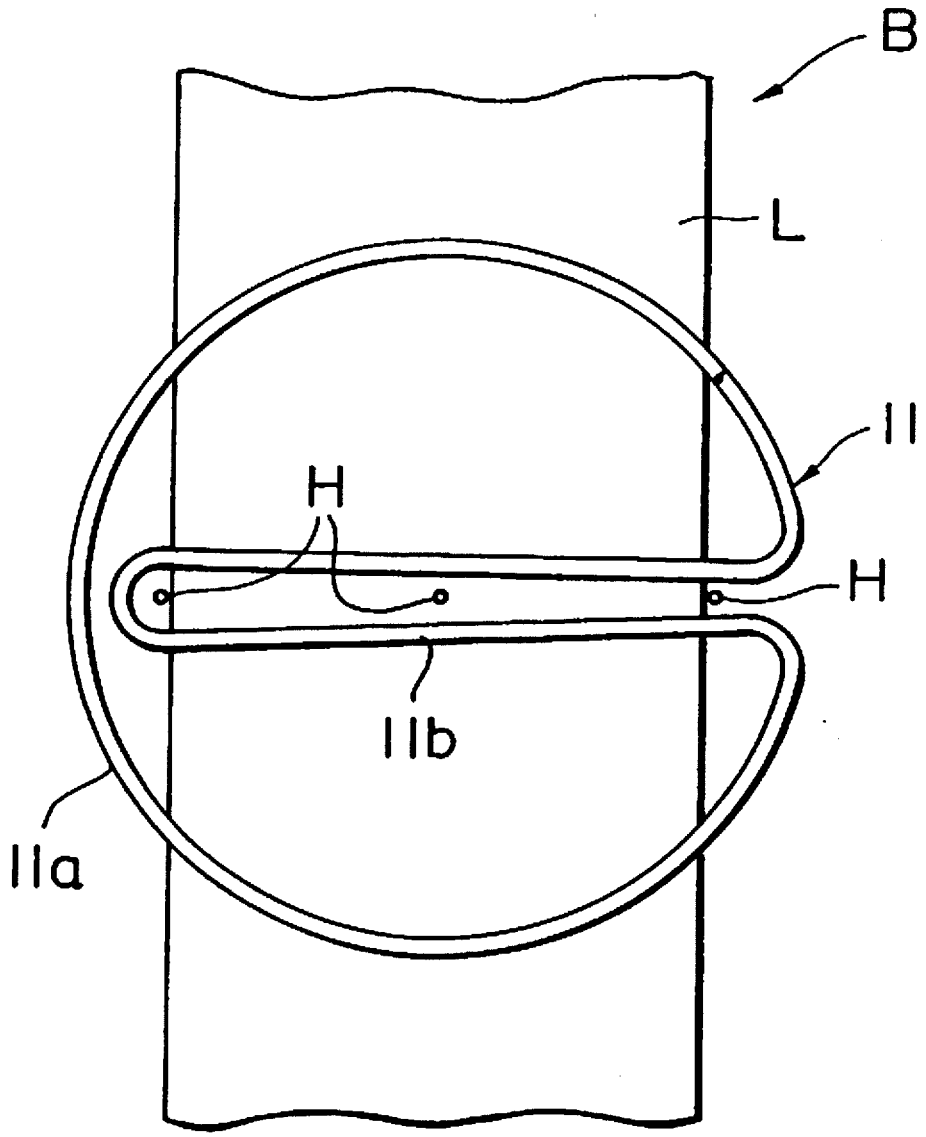
FIG. 16 is a partially cut illustrative plan view which shows by way of other example the state in which a coil spring-like spacer is set between the adjacent louvers of the blind.
Figure 17:
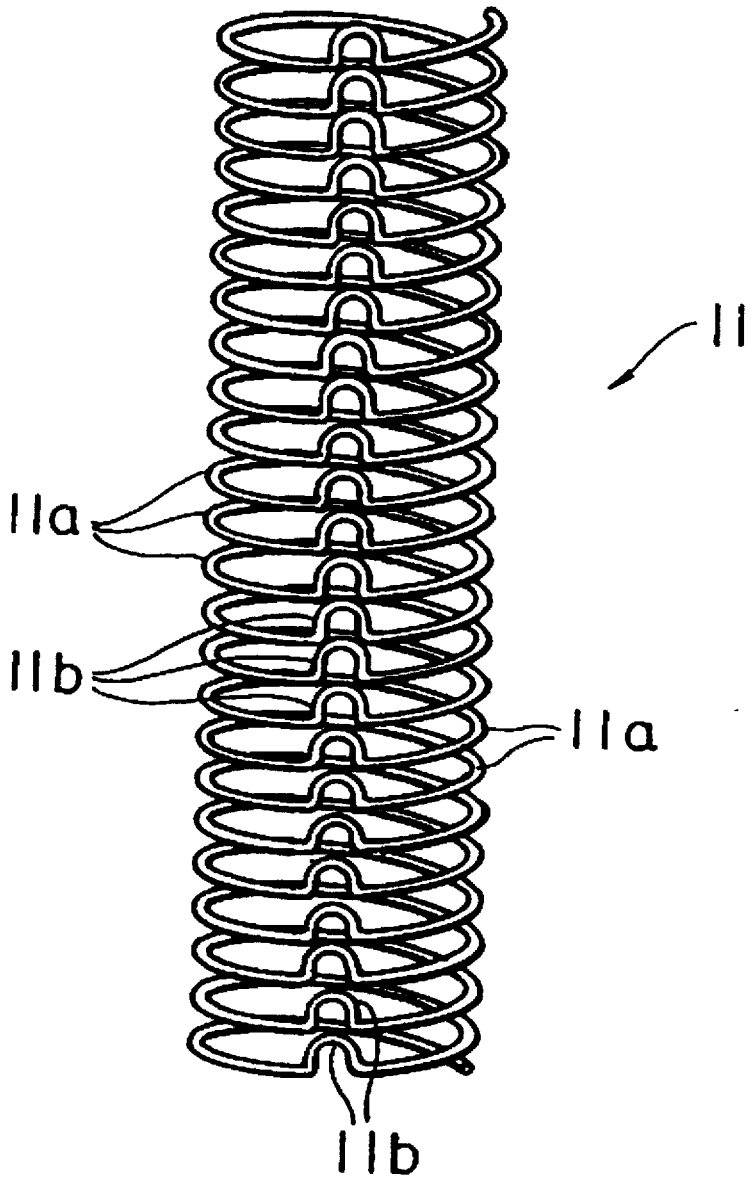
FIG. 17 is a schematic perspective view which shows by way of another example the structure of a coil spring-like spacer.

As shown in FIG. 16 and FIG. 17, the coil spring-like spacer 11 includes a plurality of U-shaped string protecting portions **11*b*, and a part of offset ring-like portion 11*a* is bent inwardy to constitute a U-shaped string protecting portion which surrounds the central portion of each offset ring-like portion. As shown in FIG. 17, the U-shaped string protecting portions 11*b* are formed at the same positions of the offset ring-like portions 11*a***.

The coil spring-like spacer 11 is dimensioned to have a diameter of about 70 mm, and the diameter of a wire constituting the coil spring-like spacer 11 is dimensioned to 2.5 mm. The coil spring-like spacer 11 is molded of an elastic plastic material.

According to this embodiment, the blind B is washed in the following manner using the foregoing components and devices.

In the same manner as the first embodiment, first, the blind B is expanded to a maximum extent to open the distance between the louvers L to a maximum extent. While the coil spring-like spacers 11 are held in the horizontal state, the coil spring-like spacers 11 are squeezed against the blind B with a vertical attitude so that the offset ring-like portions **11*a* are inserted between the vertically adjacent louvers L of the blind B. At this time, the coil spring-like spacer 11 is located at the position where strings H are present for connecting the louvers L of the blind B to each other or changing the inclination angle of the louvers B, and the opening portion side of the U-shaped string protecting portions 11*b* is oriented to the strings H, and thereafter, the coil spring-like spacer 11 is thrust against the louvers L of the blind B. As shown in FIG. 16, while the strings H are inserted in the U-shaped string protecting portion 11*b*, the offset ring-like portion 11*a*** is inserted between the vertically adjacent louvers L.

Thereafter, a step of reducing the distance between the louvers is executed.

The blind B expended to a maximum extent as mentioned above is pulled up and then reduced in conformance with a manner of usage thereof. As described above with reference to the first embodiment of the present invention, the distance between the louvers L is reduced to 2.5 mm because the distance is restricted by the offset ring-like portions **11*a* inserted between the vertically adjacent louvers L and it is reduced to a dimension corresponding to the wire constituting the coil spring-like spacer 11**. In this case, since the diameter of the wire is 2.5 mm, the distance between the louvers L is reduced to 2.5 mm.

Next, a step of washing is executed.

While the blind B is placed on the idling rollers 14 such that the gap between the louvers L is oriented to be opened in the vertical direction, the blind B is displaced in the leftward direction from the right as shown in FIG. 13. At this time, the blind B is get wetted with the water ejected from the water ejecting nozzle 15 from the foremost end of the blind B, and subsequently, as the washing liquid is ejected from the washing liquid ejecting nozzle 16, the washing liquid adheres from the foremost end of the blind B wetted with the ejected water. Then, the blind B proceeds between the rotary brush 13 and the reciprocable brush 12 while the washing liquid assumes an adequate density of detergent.

In such manner, the blind B proceeds between the reciprocable brush 12 and the rotary brush 13 from the foremost end thereof having an adequate density of washing liquid adhered thereto, and thereafter, the reciprocable brush 12 is lowered to a necessary position, and the rotary brush 13 is raised up to a necessary position so that the reciprocable brush 12 performs reciprocable movement and the rotary brush 13 performs rotary movement.

Figure 14:
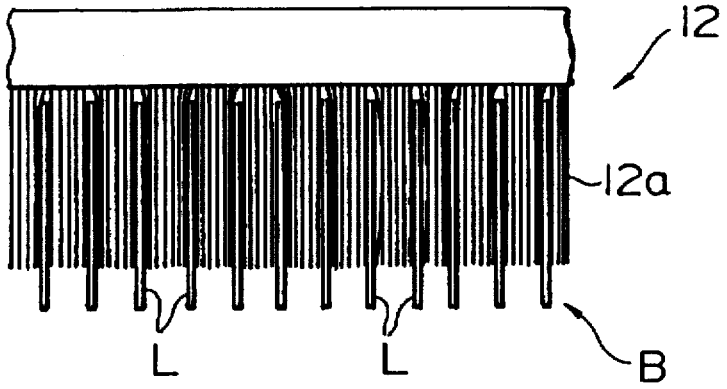
FIG. 14 is a partially cut illustrative front view which shows the state in which a reciprocable brush is received between the adjacent louvers of the blind.
Figure 15:
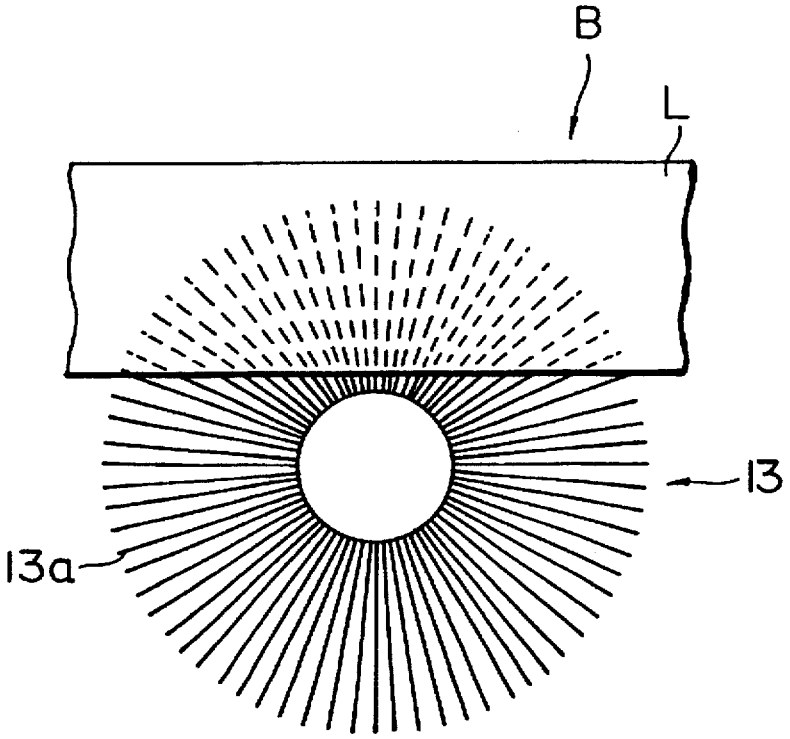
FIG. 15 is a partially cut illustrative side view which shows the state in which a rotary brush is received between the louvers of the rotary brush.

As shown in FIG. 14, a brush portion **12*a* of the reciprocable brush 12 enters between the louvers L at the foremost end of the blind B from the above and performs reciprocable movement in the longitudinal direction of the blind B, and as shown in FIG. 13, a brush portion 13*a* of the rotary brush 13** enters between the louvers L from the below to perform rotary movement whereby the surfaces of the respective louvers are washed.

Thus, the dirty material deposited on the surfaces L of the blind B is removed therefrom by the physical force imparted to the brush portion **12*a* of the reciprocable brush 12 and the brush portion 13*a* of the rotary brush 13**, and moreover, the dirty material is removed from the foregoing surface by the chemical or physical washing power corresponding to the property of the washing liquid.

As the blind B gradually proceeds corresponding to the speed of washing achieved by the reciprocable brush 12, the rotary brush 13 and the washing liquid, a washing operation can be performed from the foremost end of the blind B to the intermediate part of the same and then the intermediate part to the rearmost end of the blind B.

When the foremost end of the blind B passing between the reciprocable brush 12 and the rotary brush 13 proceeds further, as shown in FIG. 13, it is placed on the idling roller 14 located ahead of the foremost end of the blind B and smoothly moves so that a rinsing operation is performed by the water ejected from the water ejecting nozzle 17 located behind the reciprocable brush 12 to remove the washing liquid and the dirty material involved in the latter.

When the whole blind B passes past the reciprocable brush 12 and the rotary brush 13, and moreover, passes below the water ejecting nozzle 17, a washing operation for the blind B is completed.

When a certain position of the strings H disposed for connecting the respective louvers L or changing the inclination angle of the louvers L of the blind B passes between the reciprocable brush 12 and the rotary brush 13, the strings H are protected by the coil spring-like spacer 11. In some case, the reciprocable brush 12 may be raised and lowered at the foregoing position. In this case, only this part is manually washed later.

In the case that the washing liquid is insufficiently rinsed with the aforementioned extent, when only ejection of the washing liquid from the washing liquid ejecting nozzle 16 is interrupted and the same washing step is once more repeated, the rinsing operation becomes perfect.

After completion of the washing step, a drying step is executed.

First, the upper end of the washed blind B is engaged with engagement means located at a high position, the distance between the adjacent louvers is enlarged by expanding the blind B in conformance with a manner of usage, and the coil spring-like spacer 11 is disconnected from the blind B. The blind B held in the foregoing state is left immovable so that it is naturally dried.

As will be understood from the description on the first embodiment and the second embodiment of the present invention, since the distance between the respective louvers of the blind can be reduced to a necessary minimum extent using the coil spring-like spacer member, an advantageous effect is that a washing operation can be performed by small-sized washing means.

Insertion of the coil spring-like spacer member into the respective louvers is very easy, and the coil spring-like spacer member can easily and speedily be inserted between the respective louvers merely by squeezing the coil spring-like spacer member against the respective louvers in the aforementioned manner especially without any necessity for adjusting the positional relationship between the offset ring-like portion of the coil spring-like spacer member and the louvers.

In the case where the coil spring-like spacer member is constituted of a non-metallic material, there does not arise a problem that a coating at the contact portion with the louvers is injured also when supersonic vibration is utilized for the washing step.

In the case where the diameter of the offset ring-like portion of the coil spring-like spacer member is dimensioned corresponding to the width of the louver, since the coil spring like-spacer member is inserted between the vertically adjacent louvers from the foremost end to the rearmost end thereof, the gap exactly corresponding to the diameter of the wire can be kept between the louvers.

In addition, in the case that the U-shaped string protecting portion recessed in the substantially U-shaped contour is formed by inwardly bending a part of all the offset ring-like portion of the coil spring-like spacer member corresponding to each other while surrounding the center of the offset ring-like portion, since the strings disposed for connecting the louvers of the blind or changing the inclination angle of the louvers can be protected by the foregoing structure, it is convenient in the case that a washing operation is performed using brushes.

While the present invention has been described above with respect to the preferred embodiments thereof, it should be noted that the present invention should not be limited only to these embodiments but various changes or modifications may be made without departure from the scope of the present invention as defined by the appended claims.

What is claimed is:

1. A method of washing a blind, said method comprising:

enlarging a distance between adjacent louvers of a blind to be washed, each of said louvers being held in a horizontal orientation;

pressing a coil spring spacer member against said blind so as to insert offset ring portions of said coil spring spacer member between said adjacent louvers, wherein said coil spring spacer member is disposed at a right angle relative to said louvers and is formed of a wire having a diameter;

reducing the distance between adjacent louvers of said blind so as to hold said offset ring portions in a clamped state such that a gap, corresponding to said wire diameter, is formed between said adjacent louvers;

washing said blind while maintaining said gap between said adjacent louvers;

removing said coil spring spacer member from said blind; and drying said blind.

2. The method of washing a blind as claimed in claim 1, wherein said coil spring spacer member is formed of a non-metallic material.

3. The method of washing a blind as claimed in claim 1, wherein the diameter of each of said offset ring portions of said coil spring spacer member is dimensioned so as to correspond to the width of each of said louvers.

4. The method of washing a blind as claimed in claim 1, wherein said washing step includes dipping said blind in a washing liquid and displacing said washing liquid by stirring.

5. The method of washing a blind as claimed in claim 4, wherein said washing step includes generating supersonic vibrations in said washing liquid, and said vibrations are transmitted to said blind via said washing liquid.

6. The method of washing a blind as claimed in claim 1, wherein each of said offset ring portions is bent inwardly to form a U-shaped contour which surrounds a center of said each offset ring portion.

* * * * *